United States Patent [19]

Hagemeister

[11] Patent Number: 4,685,659

[45] **Date of Patent: * Aug. 11, 1987**

[54] SPRING UNIT

[75] Inventor: Robert C. Hagemeister, Boston, Mass.

[73] Assignee: Webster Spring Co. Inc., Oxford, Mass.

[ * ] Notice: The portion of the term of this patent subsequent to Mar. 25, 2003 has been disclaimed.

[21] Appl. No.: 759,876

[22] Filed: Jul. 29, 1985

[51] Int. Cl.[4] ..... A47C 23/02

[52] U.S. Cl. ..... 267/103; 5/247; 5/255; 267/108

[58] Field of Search ..... 267/103, 104, 105, 106, 267/107, 108, 109; 5/247, 255, 267, 276, 273, 260

[56] References Cited

U.S. PATENT DOCUMENTS

| | | | |
|---|---|---|---|
| 3,612,505 | 10/1971 | Bond | 5/247 X |
| 3,754,744 | 8/1973 | Ciampa et al. | 267/108 X |
| 4,398,705 | 8/1983 | Mizelle | 5/247 X |
| 4,510,635 | 4/1985 | Woffendin | 267/103 |
| 4,559,654 | 12/1985 | Mizelle | 5/255 |
| 4,577,841 | 3/1986 | Hagemeister | 5/255 X |

*Primary Examiner*—George E. A. Halvosa
*Assistant Examiner*—Matthew C. Graham
*Attorney, Agent, or Firm*—Robert T. Gammons

[57] ABSTRACT

A bent wire spring unit for interposition between a grid frame and base frame comprising upper and lower attaching elements and intervening spaced, parallel, oppositely-facing supports comprising vertical lengths of wire and at the upper and lower ends of the vertical lengths of wire, V-shaped lengths of wire, the legs of which are connected, respectively, to the vertical lengths of wire and to the attaching elements.

3 Claims, 6 Drawing Figures

SPRING UNIT

BACKGROUND OF THE INVENTION

In my pending applications Ser. No. 631,991, now U.S. Pat. No. 4,577,841 filed July 18, 1984 and Ser. No. 675,892, filed Nov. 28, 1984, there are shown and described spring units for supporting a grid frame for yield relative to a base frame. In Ser. No. 631,991, each spring unit comprises top and bottom attaching elements held in spaced relation by oppositely-facing, generally U-shaped structures and in Ser. No. 675,892, the top and bottom attaching elements are held in spaced relation by generally V-shaped structures. The arms of the U-shaped and V-shaped supporting structures are relatively long, hence, the yield is relatively soft. The structure according to the instant invention is designed to provide a configuration which will afford stiffer yield without having to increase the gage of the wire of which the spring units are comprised.

SUMMARY OF THE INVENTION

In accordance with the invention as herein illustrated, the spring units are structured to be disposed between a base frame and a grid frame to support the same for yield of the grid frame relative to the base frame and comprise vertically-disposed, spaced, parallel, oppositely-facing supports yieldably connecting the top and bottom attaching elements, each comprising a vertical length of wire of lesser length than the distance between the attaching means and V-shaped lengths of wire connecting the opposite ends of the vertical lengths to the top and bottom attaching elements.

The invention will now be described in greater detail with reference to the accompanying drawings, wherein.

Figure 1:
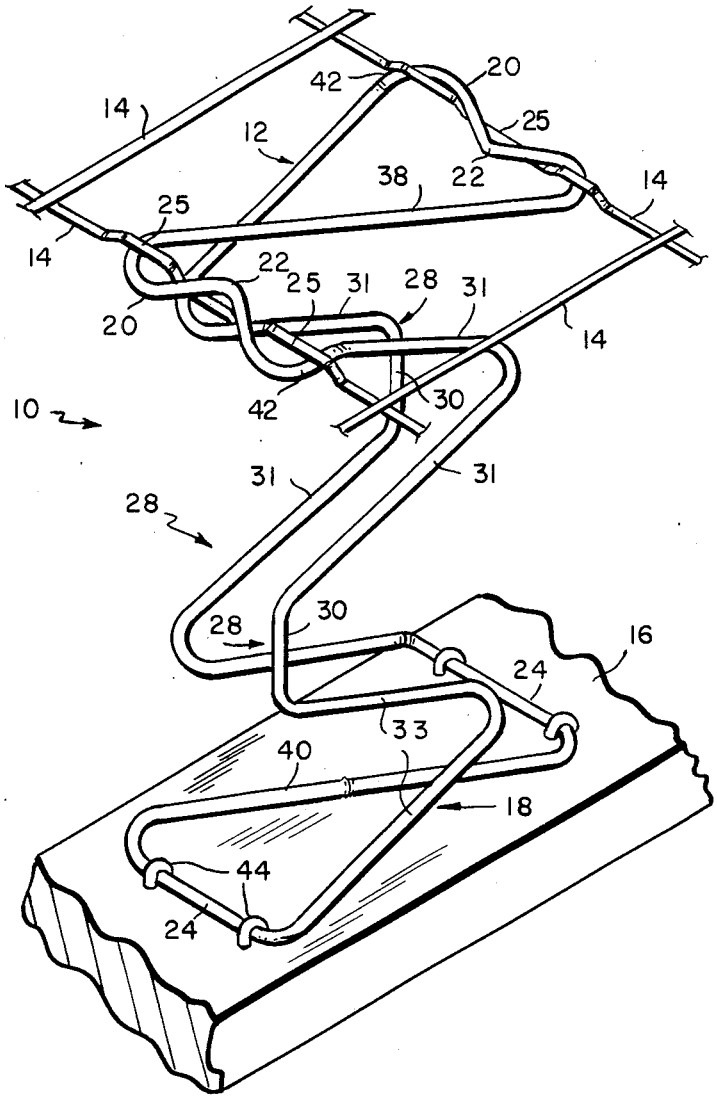
FIG. 1 is a perspective view.
Figure 6:
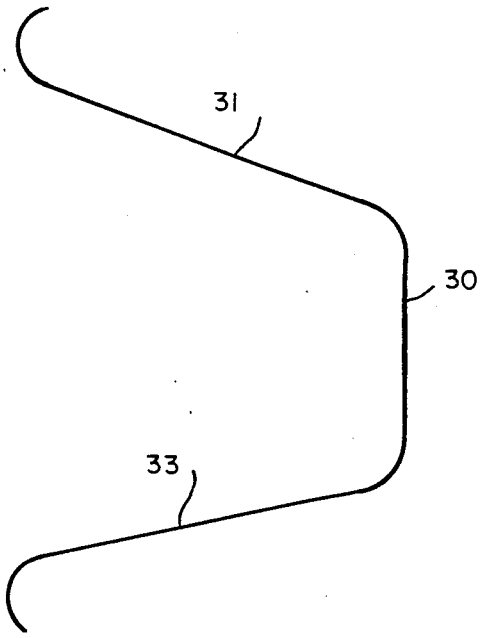
FIG. 6 is an elevation to larger scale diagrammatically illustrating the configuration of a portion of one of the supports.
Figure 3:
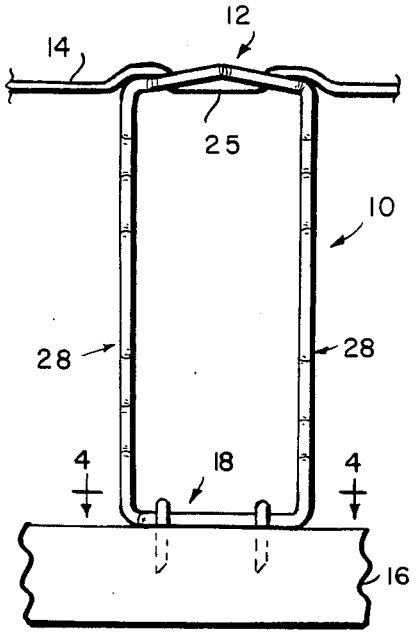
FIG. 3 is an elevation as seen from a side at right angles to FIG. 2.
Figure 2:
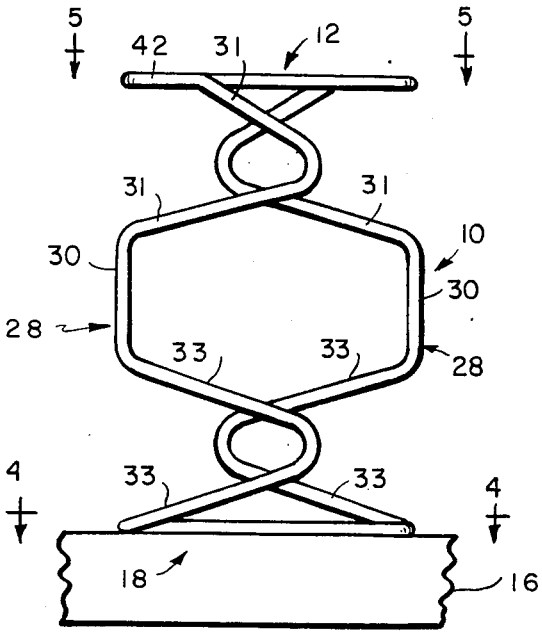
FIG. 2 is an elevation as seen from one side.
Figure 4:
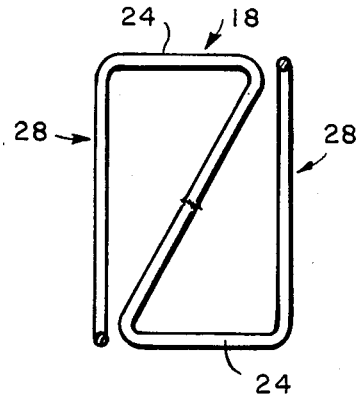
FIG. 4 is a section taken on the line 4—4 of FIG. 2.
Figure 5:
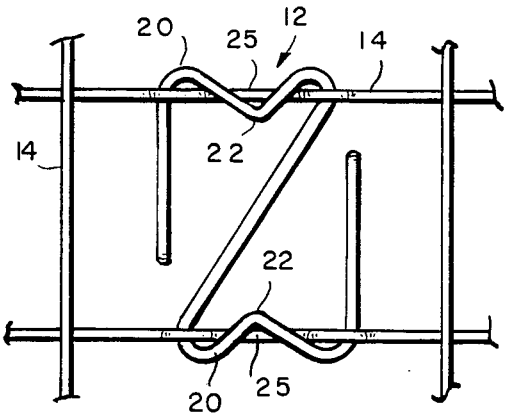
FIG. 5 is a plan view taken on the line 5-5 of FIG. 2.

Referring to FIGS. 1 to 6, the bent wire spring units 10 are disposed between longitudinal and transverse wires 14—14 of a grid frame and a transverse support bar 16 of a base frame. The bent wire spring units 10 are disposed in transversely and longitudinally-spaced relation with their upper ends attached to the longitudinal wires of the grid frame and their lower ends attached to the transverse bars of the base frame.

Each bent wire unit comprises an upper attaching element 12, a lower attaching element 18 and interposed, yieldable supports 28—28 which permit yield of the upper and lower attaching elements relative to each other. More specifically, the upper attaching element 12 comprises spaced, parallel lengths of wire 20—20 connected at their opposite ends by a diagonal length of wire 38 and the lower attaching element 18 comprises spaced, parallel lengths of wire 24—24 connected at their opposite ends by a diagonal length of wire 40. The supports 28—28 comprise generally M-shaped frames disposed in oppositely-facing relation to each other, each comprising a substantially vertical length of wire 30—30 connected at its upper and lower ends by V-shaped lengths of wire embodying legs 31—31 and 33—33. The lower one of the legs 31 and the upper one of the legs 33 are connected, respectively, to the opposite ends of the vertical length of wire 30—30 and the upper one of the legs 31 and the lower one of the legs 33 are connected to the top and bottom attaching elements 12 and 14. At the junctions of the upper ends of the wires 31—31 with the ends of the lengths of wire 20—20, there are horizontal lengths of wire 42—42 structured to prevent the grid wires 14—14 from sliding down the inclined lengths of wire 31—31.

As shown in FIG. 1, the upper attaching elements 12—12 are attached to adjacent longitudinal grid wires 14—14 by deviations 22—22 formed in the spaced lengths of wire 20—20 which extend toward each other and which are interengaged with the deviations 25—25 formed on the wires 14—14. The deviations 25—25 for securing the upper attaching elements to the wires 14—14 are like those in U.S. Pat. No. 4,004,304. The lower attaching elements 18—18 are attached to the support bar 16 by means of staples 44 driven into the bar over the lengths of wire 24—24.

The supports 28—28 provide for yield of the top attaching element 12 to the bottom attaching element 18 by bending of the legs of the V-shaped portions relative to each other and to the vertical portions 30.

The bent wire spring units 10 are symmetrical in planes at right angles to each other and provide resistance in bending and torsion to displacement and, hence, controlled yield which is stiff enough to support the edges and ends of the spring assembly in which they are used and because of the relatively short lengths making up the supports to provide for greater stiffness than is possible where the wires intervening the upper and lower attaching elements are contrived of but two lengths of wire which, because of their length, yield to a greater degree under load than the structure herein illustrated.

It should be understood that the present disclosure is for the purpose of illustration only and includes all modifications or improvements which fall within the scope of the appended claims.

What is claimed is:

1. A bent wire spring unit for disposition between a base frame and a grid frame comprising vertically-spaced, parallel top and bottom attaching elements and vertically-disposed, spaced, parallel supports connecting the top and bottom attaching elements such as to permit the top and bottom attaching elements to move relative to each other in response to pressure applied perpendicularly to the top attaching elements, said supports comprising vertical lengths of wire of lesser length than the distance between attaching elements and vertically-spaced upper and lower V-shaped lengths of wire defining downwardly-inclined lower legs and upwardly-inclined upper legs, said upper legs of the lower V-shaped lengths of wire being connected to the lower ends of the vertical lengths of wire and said lower legs of the upper V-shaped lengths of wire being connected to the upper ends of the vertical lengths of wire, said vertical lengths of wire and said inclined lengths of wire comprising the supports being disposed in perpendicular spaced, parallel planes with the vertical length of wire disposed in spaced, parallel relation to each other, both transversely and longitudinally and with the legs of the V-shaped lengths of wire extending from said vertical lengths of wire in opposite directions.

2. A bent wire spring unit according to claim 1 wherein the legs of the V-shaped lengths of wire are at an acute angle relative to each other and the lengths of the V-shaped lengths of wire connected to the vertical lengths of wire are at oblique angles to the vertical lengths of wire.

3. A bent wire spring unit according to claim 2 wherein the legs of the V-shaped length of wire are inclined at the same angle.

* * * * *